United States Patent [19]

Muschelknautz et al.

[11] B 4,012,895

[45] Mar. 22, 1977

[54] FALSE-TWISTING ARRANGEMENT FOR SYNTHETIC YARNS

[75] Inventors: Edgar Muschelknautz, Leverkusen; Hans Lenz, Dormagen-Hackenbroich; Heiko Herold, Dormagen, all of Germany

[73] Assignee: Bayer Aktiengesellschaft, Leverkusen, Germany

[22] Filed: July 10, 1974

[21] Appl. No.: 487,078

[44] Published under the second Trial Voluntary Protest Program on March 30, 1976 as document No. B 487,078.

[30] Foreign Application Priority Data

July 24, 1973 Germany ..... 2337527

[52] U.S. Cl. ..... 57/77.4; 57/106

[51] Int. Cl.[2] ..... D02G 1/02

[58] Field of Search ..... 57/77.3–77.45, 57/106, 157 TS

[56] References Cited

UNITED STATES PATENTS

| | | | |
|---|---|---|---|
| 2,718,111 | 9/1955 | Brown | 57/77.4 |
| 3,094,834 | 6/1963 | Deeley et al. | 57/77.4 X |
| 3,287,890 | 11/1966 | McIntosh et al. | 57/77.4 |
| 3,527,043 | 9/1970 | Sabaton | 57/51.6 X |

*Primary Examiner*—Donald E. Watkins
*Attorney, Agent, or Firm*—Burgess, Dinklage & Sprung

[57] ABSTRACT

A false-twisting arrangement for synthetic yarns consisting of a rotating body and yarn guides, distinguished by the fact that the yarn is pressed onto the rotating body by a jet of gas or liquid and is thereby twisted, the yarn being pressed onto the rotating body under a substantially constant force.

7 Claims, 2 Drawing Figures

FALSE-TWISTING ARRANGEMENT FOR SYNTHETIC YARNS

This invention relates to a false-twisting arrangement for synthetic yarns, consisting of a rotating body and a yarn guide.

False-twisting arrangements of this kind provide synthetic yarns, for example, with improved feel and increased elasticity.

It is known that synthetic yarns can be twisted by means of rotating bodies, for example discs. The individual yarns are pressed on to the rotating disc by means of yarn guides or rotating bodies. Unfortunately, these known arrangements are far from satisfactory because the pressure under which the yarn is brought into contact with the rotating disc is difficult to adjust and, in addition, is subject to continual variation due to the non-circularity of the disc. Any change in the contact pressure is accompanied by a change in friction and, hence, in tension over the travelling length of yarn. Both have an adverse effect upon yarn quality.

The object of the invention is to keep the pressure under which the yarn is brought into contact with the rotating body as constant as possible in order to render friction and yarn tension uniform over the travelling length of yarn.

According to the invention, there is provided a false-twisting arrangement for synthetic yarns comprising a rotating body and a yarn guide, wherein the yarn is pressed on to the rotating body by a jet of gas or liquid.

The particular advantage of the arrangement according to the invention is that, immediately after the individual yarns have been extruded, they can be pressed on to a rotating body and hence twisted, the yarns being pressed on to the rotating bodies by a substantially constant force. The individual yarns are uniformly pressed on to the rotating bodies, even where the rotating body deviates from the required roundness. This provides for uniform twisting and for uniform yarn tension over the travelling length of yarn.

In one embodiment of the arrangement according to the invention, the jet of gas or liquid impinges on the yarn 0.1 to 3 cm below the rotating body.

The particular advantage of this embodiment is that it stabilises yarn travel. Stable yarn travel at high take-off rates is obtained by virtue of the fact that, in a preferred embodiment of the arrangement according to the invention, the jet of gas or liquid impinges on the yarn at an angle of from 20° to 160°, preferably from 30° to 60°, relative to the take-off direction.

One preferred embodiment of the invention is described by way of example in the following with reference to the accompanying drawings, wherein.

Figure 1:
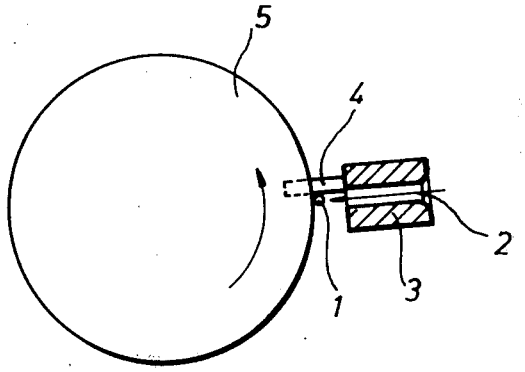
FIG. 1 is a plan view of a false-twisting arrangement in which yarn is pressed on to a rotating disc by compressed air.

As shown in FIG. 1, a yarn 1 is pressed on to a rotating disc 5 by a jet 2 of gas or liquid which is introduced through a feed pipe 3. A yarn guide 4 prevents the yarn 1 from being entrained by the disc 5. The nozzle used to produce the jet 2 of gas or liquid has an outlet opening of from 0.1 to 10 mm, preferably from 0.3 to 2 mm.

Figure 2:
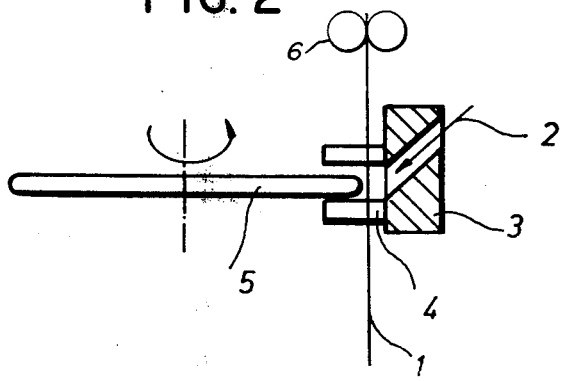
FIG. 2 is a side elevation of the arrangement shown in FIG. 1.

In FIG. 2, the yarn 1 is pressed on to the rotating disc 5 by a jet 2 of gas or liquid directed obliquely under the rotating disc 5 as it is drawn past the disc 5 by the take-off rolls 6.

What we claim is:

1. An apparatus suitable for false twisting of synthetic yarn comprising means for twisting of the yarn comprising a movably mounted edge over which the yarn can be drawn for the twisting thereof, take-off means for drawing the yarn over the moving edge of the twisting means, a yarn guide for preventing entrainment of the yarn by the moving edge, the improvement which comprises means for directing a jet of gas or liquid onto the yarn to press the yarn against the moving edge during the twisting thereof.

2. Apparatus of claim 1, said twisting means being a disc.

3. Apparatus of claim 2, wherein the jet directing means is disposed so that a jet issuing therefrom will impinge on the yarn 0.1 to 3 cm below the moving edge.

4. Apparatus of claim 1, wherein the jet directing means is disposed so that a jet issuing therefrom will impinge on the yarn 0.1 to 3 cm below the moving edge.

5. Apparatus of claim 1, wherein the jet directing means is disposed so that a jet issuing therefrom will impinge on the yarn at an angle of 20° to 160° relative to the take-off direction.

6. Apparatus of claim 1, wherein the jet directing means is disposed so that a jet issuing therefrom will impinge on the yarn at an angle of 30° to 60° relative to the take-off direction.

7. In the process of false twisting synthetic yarn which comprises drawing the yarn over the moving edge of a movably mounted twisting means, the improvement which comprises, pressing the yarn against the moving edge by directing a jet of gas or liquid onto the yarn during said drawing.

* * * * *